US006564954B1

(12) United States Patent
Buhlmayer et al.

(10) Patent No.: US 6,564,954 B1
(45) Date of Patent: May 20, 2003

(54) ROPE HOIST WITH ELASTIC FRAME

(75) Inventors: Reiner Buhlmayer, Pfedelbach (DE); Helmut Noller, Uttenhofen (DE); Richard Muller, Gaisbach (DE); Anita Schmiedt, Neuenstein (DE); Manfred Finzel, Kunzelsau (DE)

(73) Assignee: R. Stahl Fordertechnik GmbH (DE)

( * ) Notice: Subject to any disclaimer, the term of this patent is extended or adjusted under 35 U.S.C. 154(b) by 0 days.

(21) Appl. No.: 09/242,510

(22) PCT Filed: Jun. 8, 1997

(86) PCT No.: PCT/DE97/01690

§ 371 (c)(1),
(2), (4) Date: Feb. 16, 1999

(87) PCT Pub. No.: WO98/07647

PCT Pub. Date: Feb. 26, 1998

(30) Foreign Application Priority Data

Aug. 22, 1996 (DE) ..... 196 33 837

(51) Int. Cl.[7] ..... B66C 19/00
(52) U.S. Cl. ..... 212/71; 212/328
(58) Field of Search ..... 212/321, 71, 328, 212/329, 330, 331, 346

(56) References Cited

U.S. PATENT DOCUMENTS

| | | | | |
|---|---|---|---|---|
| 1,945,712 A | * | 2/1934 | Wado | |
| 1,995,298 A | * | 3/1935 | Fitch | |
| 2,282,985 A | * | 5/1942 | Schroeder | |
| 2,514,494 A | * | 7/1950 | Holdeman | |
| 3,339,753 A | * | 9/1967 | Forster et al. | |
| 3,550,787 A | * | 12/1970 | Hicks | 212/125 |
| 3,758,079 A | * | 9/1973 | Workman et al. | 254/168 |
| 3,773,294 A | * | 11/1973 | Alcott | 254/187 |
| 4,123,040 A | | 10/1978 | Kuzarov | 254/166 |
| 4,440,041 A | * | 4/1984 | Bendtsen | 74/753 |
| 4,458,882 A | * | 7/1984 | Schorling | 254/344 |
| 4,667,835 A | * | 5/1987 | Kirk | 212/346 |
| 4,736,929 A | * | 4/1988 | McMorris | 254/344 |
| 4,773,504 A | * | 9/1988 | Reed et al. | 182/38 |
| 4,892,203 A | * | 1/1990 | Arav | 212/221 |
| 5,072,840 A | * | 12/1991 | Asakawa et al. | 212/346 |
| 5,378,082 A | * | 1/1995 | Hiller et al. | 405/3 |

FOREIGN PATENT DOCUMENTS

| | | | |
|---|---|---|---|
| DE | 536 115 | | 11/1931 |
| DE | 889 360 | | 9/1953 |
| DE | 1 205 247 | | 11/1965 |
| DE | 1 269 317 | | 5/1968 |
| DE | 37 43 889 | | 7/1988 |
| EP | 678473 | * | 4/1975 |
| EP | 0 065 503 | | 11/1982 |

* cited by examiner

*Primary Examiner*—Thomas J. Brahan
(74) *Attorney, Agent, or Firm*—Leydig, Voit & Mayer, Ltd.

(57) ABSTRACT

In a rope hoist (9), the rope drum (17) is rotatably mounted in a roughly C-shaped frame (13). To mount the rope drum (17), an appropriate bearing arrangement 37) is provided at one side, whereas at the other side the mounting of the rope drum (17) is effected solely via the output shaft (61) of the gearing (19). Distortions in the frame (13 ) on account of unavoidable alignment errors are absorbed by the torsionally nonrigid frame (13).

31 Claims, 5 Drawing Sheets

ROPE HOIST WITH ELASTIC FRAME

BACKGROUND OF THE INVENTION

1. Field of the Invention

Rope hoists have an essentially cylindrical rope drum, which is rotatably mounted in a frame. The rope drum is driven by means of a geared motor, the output shaft of the gearing being coupled to the rope drum in a rotationally locked manner. During the manufacture of the frame, alignment errors, in accordance with the manufacturing tolerances, are to be expected between the bearing seats for mounting the drum and the fastening points for the geared motor. So that these tolerances do not lead to distortions in the drive, a shaft coupling which can absorb these alignment errors has been used in the past between the output shaft and the rope drum. A disadvantage in this case is the high production and assembly cost resulting from the shaft coupling and the fact that essentially three bearings are required, namely two bearings for mounting the drum and a bearing device for mounting the output shaft of the gearing.

2. Description of the Related Art

It has therefore been attempted to restrict the number of bearings or to change their position, inter alia with the aim of dispensing with the shaft coupling between the rope drum and the output shaft of the gearing. However, the rope drum on the gearing side may then no longer be mounted in a bearing accommodated in the frame. On the contrary, the bearing must become part of the gearbox, so that, with small tolerances, it is in alignment with the bearing of the output shaft. DE 37 43 889 C2 discloses such a design. In the rope hoist described there, the gearbox is provided with a bearing seat for accommodating a bearing on which one end of the rope drum is directly mounted. The gearing in turn is fastened to the frame. As a result of this arrangement, alignment problems may now occur between the two rope-drum bearings, since one of the bearings is formed directly in the frame, whereas the other is part of the geared motor. In order to cope with the distortions which unavoidably occur as a result, the fastening of the gearing to the frame is of elastic design. In addition, that end of the rope drum which is remote from the gearing is likewise mounted in the frame via elastic elements.

The cost of this is relatively high.

A somewhat different method is adopted in the rope hoist according to FR 1 458 160 A1. In this solution, the frame for mounting the rope drum has half pillow blocks, which are open at the top and in which ball bearings are inserted. An elastic compliant layer is located between the ball bearing and the bearing seat in the pillow block. The rope drum is provided with one-piece end disks, a bearing journal being inserted into each of them. One of the bearing journals is at the same time the output shaft of the gearing of the geared motor.

On account of this design, the gearing and the geared motor are carried by the output shaft, which is mounted in one of the drum pillow blocks. This solution, too, does not reduce the number of bearings for mounting the output shaft and the rope drum.

This additional bearing is dispensed with in the rope hoist according to DE-B 1 205 247. In the known arrangement, the drive motor for driving the rope drum sits inside the rope drum. For this purpose, the rope drum has a recess at one end, and an annular end plate is inserted into this recess. The bore of the end plate constitutes a bearing seat for a ball bearing, with which the rope drum is rotatably mounted on a tubular extension of the motor casing. The tubular extension of the motor arranged in the rope drum leads out of the rope drum and is screwed outside the rope drum to a flange plate. In addition, the armature shaft of the motor projects from the rope drum, so that the armature shaft can be connected to a brake device on the other side of the flange plate.

Inside the rope drum, the motor casing is actually overhung and is supported at the end lying inside the rope drum only by the armature shaft, which is rotatably mounted with a needle bearing in the output shaft of the gearing, the output shaft projecting into the rope drum. Likewise located coaxially inside the output shaft of the gearing is the gearing input shaft, which is connected in a rotationally locked manner to gears outside the rope drum. The output shaft and thus also the input shaft mounted in the output shaft are mounted in a tubular extension of the gearbox, which projects into the rope drum.

The output shaft is in one piece with a radially extending flange, which is screwed to an annular web located inside the rope drum.

On account of this arrangement, the rope drum, the motor and the gearing form a self-contained, self-supporting unit, which no longer requires further outer frames for the purpose of positioning the individual shaft bearings and fastening them in the correct position. In the known design, the rope drum forms the actual frame, on which all the rolling-contact bearings of the arrangement are supported indirectly or directly. The additional yoke, which overlaps on both sides of the rope drum and is connected at one end to the flange plate, on which the motor casing is mounted, and which is fastened at the other end to the tubular extension of the gearbox, merely constitutes a device which is necessary in order to be able to suspend the rope hoist on a supporting framework. Bearing forces are not transmitted in this respect.

Since the rope drum is the actual frame of the rope hoist, the rope drum and also all the other bearing devices must be machined to a very high accuracy, so that the alignment errors of the parts rotating relative to one another are as small as possible. Otherwise, large bearing forces would be produced on account of the rigidity of the rope drum, and these bearing forces would quickly lead to the destruction of the bearings.

OBJECTS AND SUMMARY OF THE INVENTION

Against this background, the object of the invention is to provide a rope hoist in which the gearing-side mounting of the rope drum is effected solely via the output shaft and in which no great demands are made on the production accuracy of the frame.

This object is achieved according to the invention with the rope hoist having the features of claim 1.

Compared with the rigid design of the frame, the torsionally nonrigid, elastic frame reduces the distortion forces which occur if the axes of the bearings of the rope drum are laterally offset from one another, that is, have lateral runout, and also reduces the forces which are produced if one or both bearing journals exhibit wobbling runout. In a torsionally rigid frame, these design errors would lead to forces which would immediately destroy the rolling-contact bearings. This is not the situation in the case of the compliant frame. Furthermore, in the case of the compliant frame, the additional fastening means for the gearing which are disclosed by the prior art are unnecessary, as a result of which the fastening of the gearing to the frame is substantially simplified.

It was surprising in this case that the compliant frame, i.e. the frame which is no longer torsionally rigid, is nonetheless able to absorb the forces which occur when the maximum load in accordance with the intended use hangs on the rope of the rope hoist.

Furthermore, a simplification becomes apparent by virtue of the fact that the mounting of the output shaft of the gearing is used as one of the two drum bearings. Alignment problems between the gearing-side drum mounting and the mounting of the output shaft thus do not occur, and no countermeasures have to be taken in order to cope with possible alignment errors. Thus the configuration of the entire construction is thereby also substantially simplified.

In particular, the novel design of the rope hoist is suitable for use in combination with a crab carriage, the frame for mounting the rope drum representing a cheek of the crab carriage.

Especially favorable forces or compliance ratios of the frame are obtained if the frame-base means has a roughly C-shaped configuration as viewed from the position of the rope drum. This C-shaped configuration can be achieved if the frame-base means has a longitudinal member extending parallel to the rope drum. Elongated head pieces may be welded to this longitudinal member. The head pieces are elongated structures, which run transversely to the longitudinal member, preferably vertically in the operating position of the rope hoist.

A favorable ratio between strength and mass is achieved if the longitudinal member and/or the head pieces are tubular, preferably having a square cross section.

Good compliance of the frame in the face of distortion forces as a result of alignment errors of the bearing journals of the rope drum on the one hand and sufficient strength in the face of forces which are caused by the load hanging on the rope are achieved if the frame, in plan view, has a roughly C-shaped configuration, which is defined by the frame-head means and the frame-base means. In the case of a C-shaped configuration, the frame-head means can be moved relatively easily at an angle to one another, specifically in the sense of a bending load on the frame-base means, if the axes of the two bearing journals enclose an angle with one another which is different from 180°. In the case of such an alignment error, the frame-base means would be periodically stressed in bending. Vertical offset of the journals, however, would lead to torsion of the frame-base means.

Compliance is promoted if the frame-head means to which the gearing is fastened and/or the frame-head means to which the other bearing, i.e. the drum bearing arrangement, is fastened, has an essentially platelike configuration.

An even greater degree of elasticity of the frame and easier assembly are achieved if at least one of the frame-head means, preferably the frame-head means connected to the gearing, is bifurcated with the formation of two legs. In this arrangement, the output shaft passes through between the two legs of the frame-head means.

Since, in the novel embodiment, tumbling forces or tumbling movements are deliberately tolerated for the frame, provision must be made for especially reliable fastening of the gearing to the relevant frame-head means. Such especially reliable fastening is achieved if pairs of holes in alignment with one another are contained in the frame-head means and the gearbox, a flanged bush fitting in each pair of holes. The shearing forces caused by the attachment are thus transmitted via the flanged bush, whereas a screw leading through the flanged bush is free of shearing forces and merely transmits tensile forces.

The assembly of the novel rope hoist is simplified if the output shaft is provided with a one-piece flange plate, which fits into a corresponding locating seat of the rope drum. The motor gearing unit can thereby be manufactured and dispatched as a preassembled unit.

An especially simple assembly of the output shaft is achieved in the novel rope hoist if the output gear, which sits on the output shaft, is profile-interlocked with the latter.

With its frame, the novel rope hoist may be part of a complete crab carriage, the frame constituting a cheek of the carriage.

In addition, developments of the invention are the subject matter of subclaims.

BRIEF DESCRIPTION OF THE DRAWINGS

An exemplary embodiment of the subject matter of the invention is shown in the drawing, in which.

DESCRIPTION OF THE PREFERRED EMBODIMENTS

Figure 1:
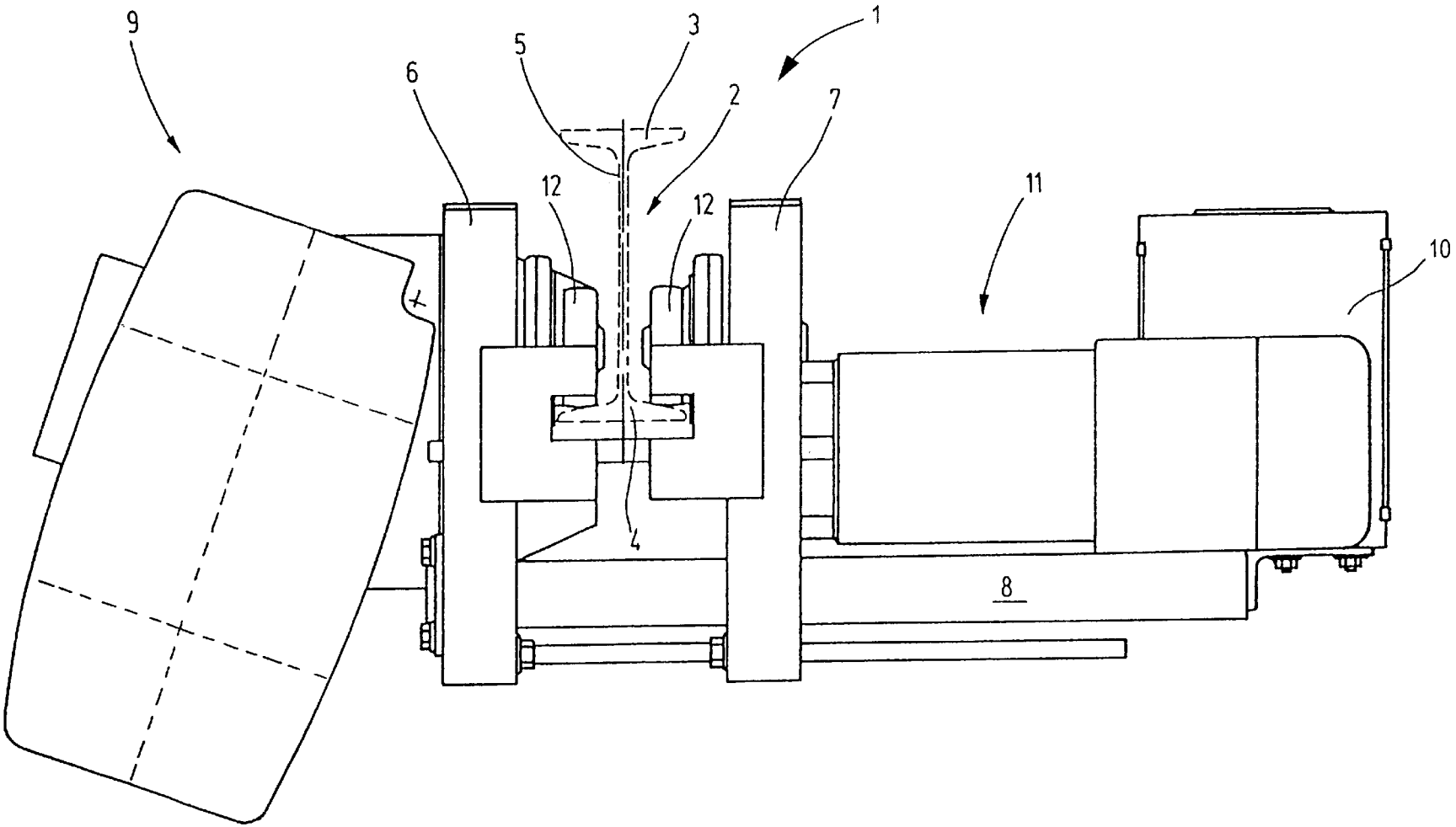
FIG. 1 shows a crab with a novel rope hoist in an end view.

Illustrated in FIG. 1 is a crab 1, which is intended to run along a travel rail 2. The travel rail 2 consists of an I-girder having a top flange 3, a bottom flange 4 and a straight web 5 connecting the two flanges to one another. The crab carriage 1 runs on the top side of the bottom flange 4.

Belonging to the main components of the crab 1 are two carriage cheeks 6 and 7, which are arranged in parallel at a distance from one another and between which the travel rail 2 runs and which are connected to one another via two connecting columns 8 parallel to one another.

The carriage cheek 6 comprises a rope hoist 9, whereas the other carriage cheek 7 is provided with a travel-drive motor 11 and a counterweight 10.

Rotatably mounted on the sides facing one another of the two carriage cheeks 6 and 7 are a total of four running wheels 12, of which the two running wheels 12 facing the viewer are set in rotation together via the travel-drive motor 11.

Figure 2:
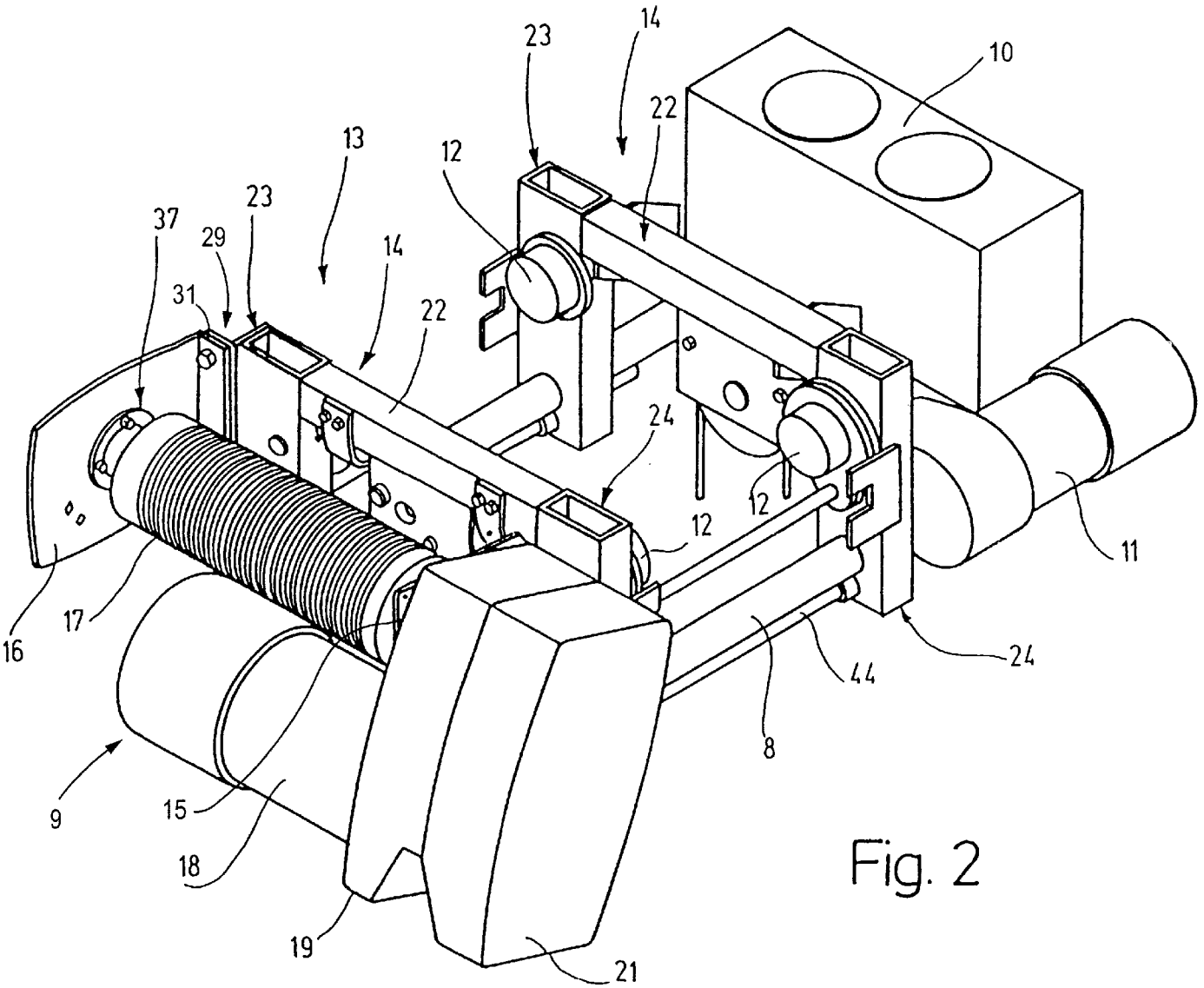
FIG. 2 shows the crab according to FIG. 1 in a perspective plan view.
Figure 3:
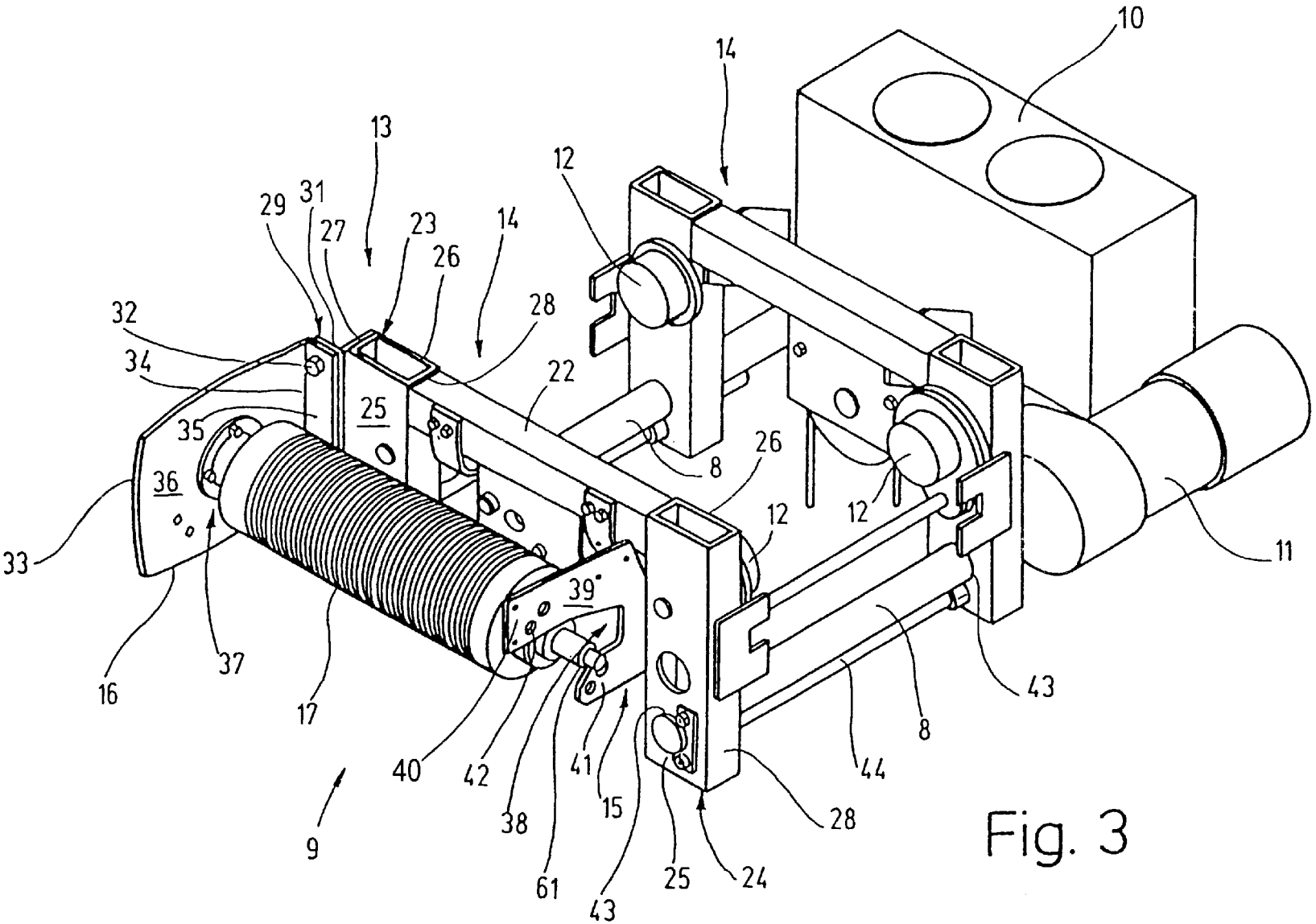
FIG. 3 shows the crab according to FIG. 2 while omitting the drive motor and the gearing.

According to FIGS. 2 and 3, the carriage cheek 6 is formed by a frame 13 of the rope hoist 9, and belonging to said carriage cheek 6 is an elongated frame base 14, which extends in a direction parallel to the travel rail 2 and on which the two running wheels 12 are rotatably mounted, as well as two frame head 15 and 16 fastened to the frame base 14. The frame heads 15 and 16 are robust sheet-metal plates, which are screwed to the frame base 14 and run in parallel to and at a distance from one another. Rotatably mounted between the two frame heads 15 and 16 is a rope drum 17, which is driven by a drive motor 18 via gearing 19. As the figure also shows, the gearing 19 is screwed to the frame head 15; specifically, it is located on the side remote from the frame head 16.

For the sake of completeness, it may also be mentioned at this point that a terminal and control box 21 is arranged on the gearing 19.

The frame base means 14 consists of a longitudinal member 22 made of a square tube, to the two end faces of which two vertically running head pieces 23 and 24 are welded. As FIG. 3 shows, the connection between the longitudinal member 22 and the two head pieces 23 and 24 is made at the top end of the head pieces 23 and 24.

The two head pieces 23 and 24, which likewise consist of a section of a square tube, have the same cross-sectional profile and are defined by two flat sides 25 and 26, parallel to one another in pairs, and two narrow sides 27 and 28, which are at right angles to the flat sides 25 and 26 and to this end are likewise parallel to one another.

An angle rail 29 covering the length of the head piece 23 is welded to the narrow side 27 of the head piece 23, and the leg 31 of this angle rail 29 runs parallel to the plane defined by the flat side 25. The frame head 16 is screwed to the leg 31 by means of two screws 32 (for reasons of representation only one of the two screws 32 can be seen; the other is concealed by the rope drum 17). The frame head 16 consists of a sheet-metal plate 33, which is angled at 34 while forming a fastening flange 35. The fastening flange 35 rests flat on the leg 31 of the angle rail 29.

The bending at an angle along the edge 34 results in a flat plate 36, which projects at right angles from a plane which is defined by the two flat sides 25 of the two head pieces 23 and 24. A drum bearing arrangement 37 is located approximately in the center of this essentially rectangular plate 36.

The other frame head 15 is screwed or welded to the other head piece 24 below the longitudinal member 22, specifically on the narrow side 27. This frame head 15 likewise consists of a flat steel plate 39, which is perpendicular to the abovementioned plane which is defined by the two flat sides 25 of the two head pieces 23 and 24.

The frame head 15 is provided with a slot or jaw 38, which results in two legs 40 and 41, which virtually bifurcate the frame head 15. The slot 38 is located at the level of the drum bearing arrangement 37. Its width results from the configuration, specified further below, of the mounting of the rope drum 17 on the other side, where the gearing 19 sits.

To fasten the gearing 19, a total of four fastening holes 42 are provided in the two legs 40 and 41 on either side of the slot 38.

As FIG. 3 shows, the frame cheek 7 of the crab carriage 1 is constructed using the frame base 14 described above.

These two cheeks 6 and 7 are rigidly connected to one another by the connecting columns 8. These connecting columns 8 lead through holes 43 at the bottom end of the head pieces 23 and 24 below the travel rail 2. The distance is fixed by means of a threaded rod 44 arranged below each connecting column 8.

The mounting of the rope drum 17 and the construction of the gearing 19 are explained below with reference to FIG. 4.

Figure 4:
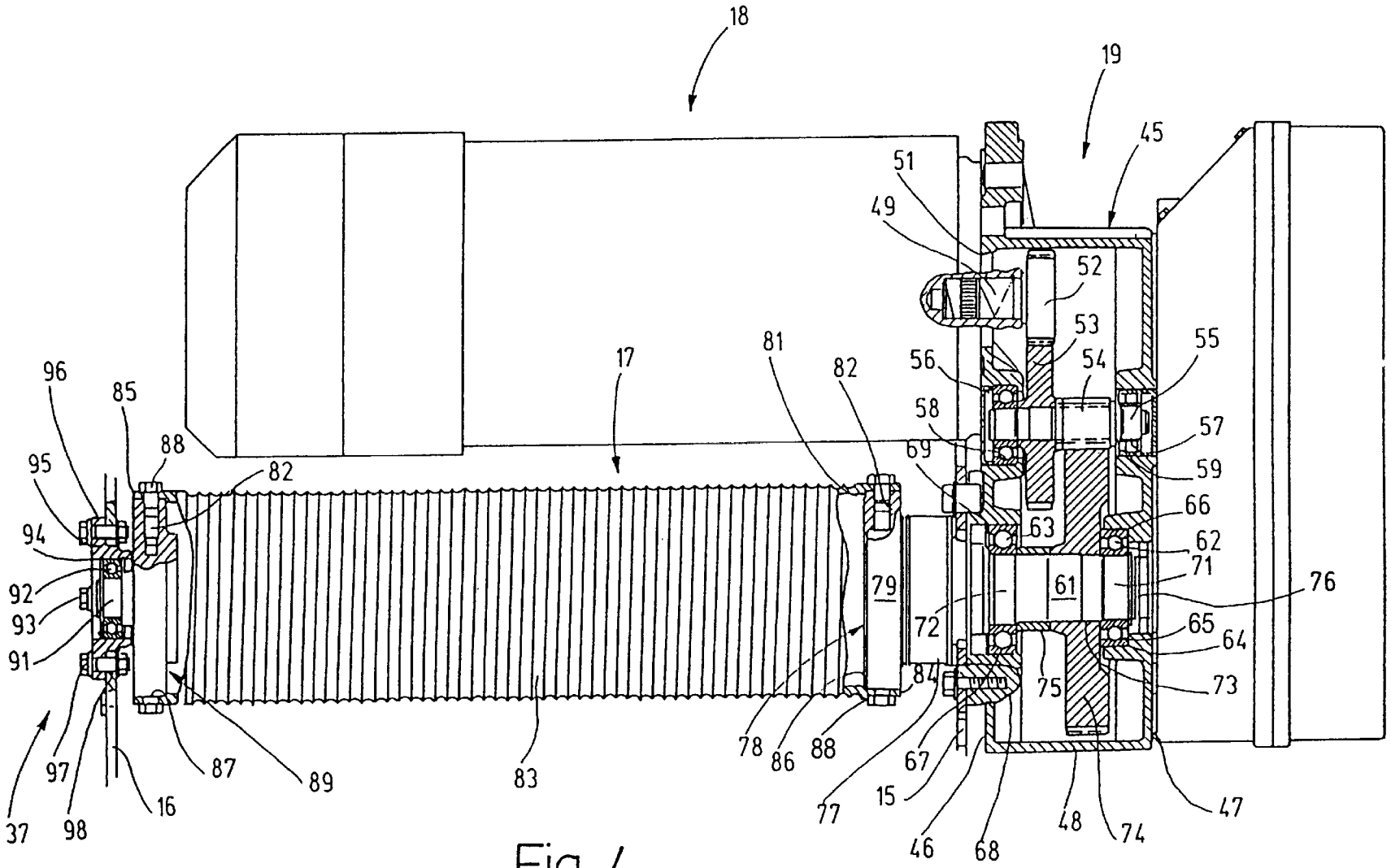
FIG. 4 shows a plan view of a detail from FIG. 2, the gearbox and the other drum bearing being longitudinally sectioned.

As FIG. 4 shows, the gearing 19 comprises a gearbox 45, which is formed by two gearbox end walls 46 and 47, arranged parallel to one another and at a distance from one another, and a side-wall arrangement 48 extending between the two gearbox end walls 46 and 47 and closed in all round. The side-wall arrangement 48 is in one piece with the two gearbox end walls 46 and 47. This results in an especially torsionally rigid construction, which is able to directly mount the motor 18.

The motor 18 is screwed by fastening means (not shown in any more detail) to the gearbox end wall 46 appropriately reinforced in this region, its armature shaft 49 projecting through a hole 51 in the gearbox end wall 46 into the interior of the gearbox 45. A drive pinion 52 sits in a rotationally locked manner on that end of the armature shaft 49 which projects into the gearbox 45. This drive pinion 52 meshes with a gear 53, which is arranged in a rotationally locked manner together with a further pinion 54 on a layshaft 55.

The layshaft 55 is rotatably mounted by means of two rolling-contact bearings 56 and 57. The rolling-contact bearing 56 is located in a bearing seating bore 58 in the gearbox end wall 46, whereas the ball bearing 57 is arranged in a bearing seating bore 59 which is located in a protuberance of the gearbox end wall 47. The two bearing seats 58 and 59 are in alignment with one another.

Axially parallel to the layshaft 55, the gearing 19 contains an output shaft 61, which is likewise rotatably mounted in the gearbox 45 by means of two ball bearings 62 and 63. There is a protuberance 64, projecting inward, in the gearbox end wall 47 where the ball bearing 62 is located, and this protuberance 64 is provided with a bearing seating bore 65 into which the ball bearing 62 is pressed. The bearing seating bore 65 ends at an annular shoulder 66, which points toward the ball bearing 63.

In alignment with the bearing seating bore 65 is a bearing seating bore 67, which is made in a protuberance 68, pointing inward, of the gearbox end wall 46. The bearing seating bore 67 has a larger diameter than the bearing seating bore 65, so that, although the gearbox 45 is in one piece, the ball bearing 62 can be pressed through the bearing seating bore 67 into the bearing seating bore 65. A retaining ring 69 arranged further on the outside secures the ball bearing 63 toward the outside in the bearing seating bore 67.

Formed on the output shaft 61 are two bearing seats 71 and 72, which are adapted to the ball bearings 62 and 63 and are also at a distance from one another corresponding to the distance between the two ball bearings 62 and 63.

Both bearing seats 71 and 72 are cylindrical surfaces, the diameter of the bearing seat 71 being smaller than the diameter of the bearing seat 72. Formed at 73 between the two bearing seats 71 and 72 is a profile interlocking system, for example a multi-spline interlocking system, which serves to locate a hub bore of an output gear 74 in a rotationally locked manner. The output gear 74 meshes with the pinion 54 and bears with the right-hand end face against the inner bearing race of the deep-groove ball bearing 62. So that the output gear 74 on the output shaft 61 cannot slip to the left, a distance ring 75 is located on the output shaft 61 between the deep-groove ball bearing 63 and the output gear 74.

An axial force, directed to the right with respect to FIG. 4, of the output shaft 61 is transmitted by an annular shoulder formed on the bearing seat 72 via the inner bearing race of the deep-groove ball bearing 63, the distance sleeve 75 and the output gear 74 to the deep-groove ball bearing 62, which is supported against the annular shoulder 66. A force directed to the left, on the other hand, is introduced by the output shaft 61 via a retaining ring 76 on the right-hand outside of the inner bearing race of the deep-groove ball bearing 62 and is transmitted from there via the output gear 74, the distance bush 75 and the deep-groove ball bearing 61 to the retaining ring 69.

At its side adjacent to the gearbox end wall 46, the output shaft 61 merges into a neck part 77, which projects through slot 38 in the frame-head means 15.

An annular end plate 78 is integrally formed on the neck part 77 on the other side of the frame-head means 15.

The annular end plate 78 is a cylindrical thick disk having a cylindrical outer circumferential surface 79, which merges at the end face remote from the neck part 77 into a faced annular surface 81. A total of four tapped holes 82 are located in the end plate 78.

The rope drum 17 itself is an essentially cylindrical tube, in the outer circumferential surface of which rope grooves 83 are made. At its two front ends 84 and 85, the rope drum 17 is provided with recesses 86 and 87 forming locating seats. Each recess 86 or 87 respectively consists of a cylindrical bore, which starts from the front end 84 or 85 respectively and is concentric to the axis of the rope drum 17. At its inner end, the cylindrical recess 86 or 87 respectively is defined by an annular shoulder. The inside diameter of the recess 86 or 87 respectively is exactly equal to the outside diameter of the cylindrical surface 79 on the end plate 78.

Finally, in the region of the recess 86, the rope drum 17 contains a plurality of radially running holes, which correspond in diameter and number to the holes 82 in the end plate 78.

In the fitted-together state, the annular surface 81 bears on the annular shoulder of the recess 86, and the holes 82 are in alignment with the holes in the rope drum 17. In this state, a corresponding number of screws 88 can be screwed into the tapped hole 82.

The rope drum 17 is designed in the same way at the other front end 85, for which reason the same reference numerals are used in this respect for the structural elements appearing there.

A further end plate 89, which in its circumferential contour is identical to the end plate 78, sits in the recess 87 at the front end 85. The difference merely consists in the fact that the end plate 78 merges into the output shaft 61, whereas the end plate 89 merges into a bearing journal 91. The structural elements at the end plate 89 which are necessary for the interaction with the rope drum 17 are therefore provided with the same reference numerals as at the end plate 78.

The bearing journal 91 forms a seating surface for a deep-groove ball bearing 92. The deep-groove ball bearing 92 is axially secured on the bearing journal 91 by means of a retaining ring 93.

The deep-groove ball bearing 92 fits in a cylindrical bearing seating bore 94 of a bearing seating support 95, which is firmly screwed with its outwardly pointing flange 96 to the outside of the frame head 16. To this end, an appropriate number of screws 97 lead through corresponding holes in the bearing support 95 and the plate- or sheetlike frame head means 16. In addition, the frame head 16 contains a hole 98 for the passage of the bearing support 95.

The deep-groove ball bearing 91 is axially secured in the bearing bore 94 by means of two internal retaining rings (not shown in any more detail) at an appropriate distance from one another.

Figure 5:
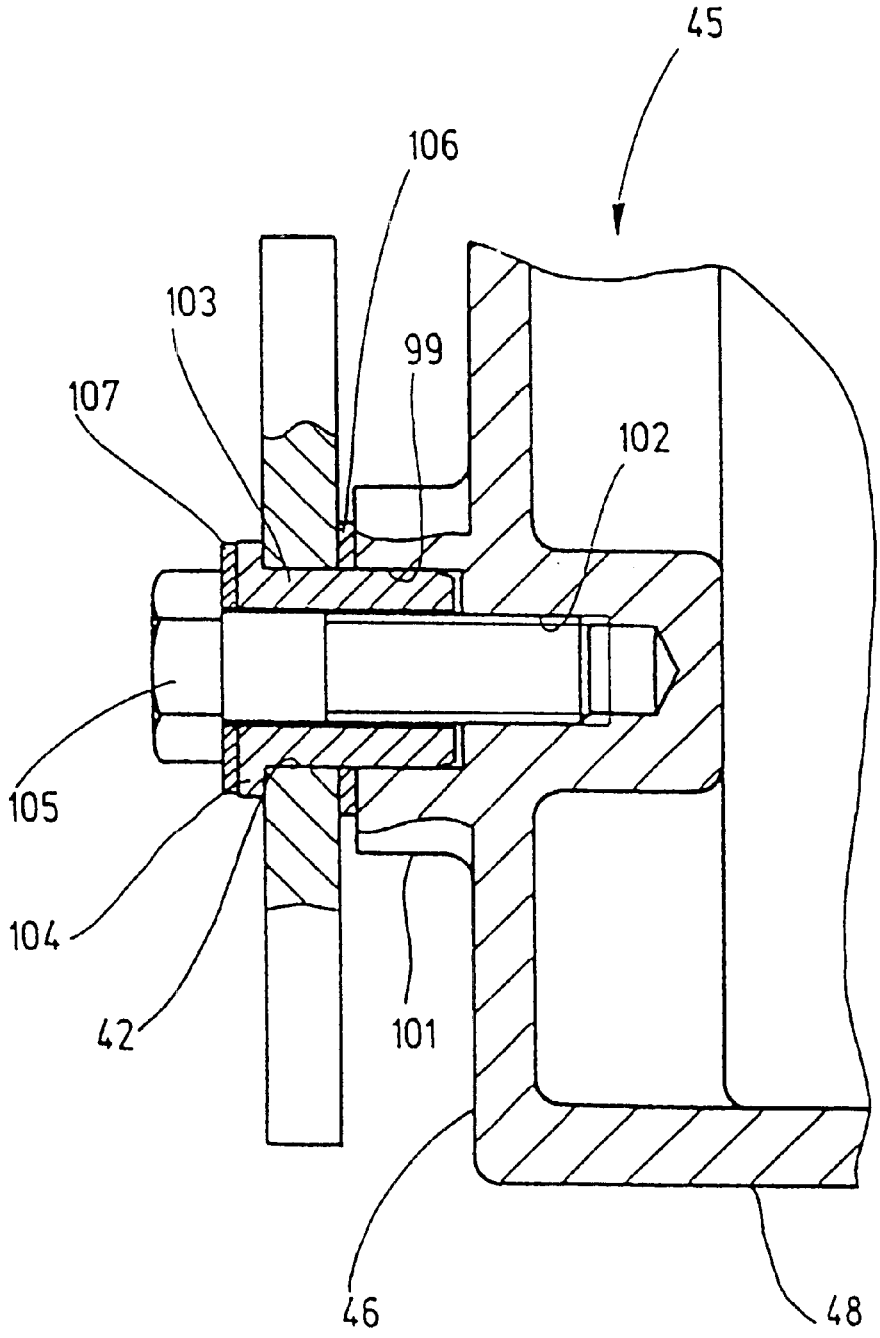
FIG. 5 shows a cross section through a connecting point between a frame-head means and the gearbox, partly sectioned.

FIG. 5 shows in detail the attachment of the gearbox 45 to the frame head 15. According to FIG. 5, a corresponding fitting hole 99, which is located in an extension 101, projecting outward, on the gearbox end wall 46, is provided in each case for each fastening hole 42 in the frame head 15, i.e. in the two legs 40 and 41. Coaxially to the fitting hole 99, the gearbox end wall 46 contains a tapped hole 102.

In the assembled state, a flanged bush 103 leads from the side of the rope drum 17 through the holes 42 and 99 in alignment with one another, the flange 104 of the flanged bush 103 bearing on that plane side of the frame head 15 which is remote from the gearbox 45. Finally, a cap screw 105 is screwed from the flange 104 into the tapped hole 102 and restrains the frame head 15 against the gearbox 45. In the process, the flanged bush 103 keeps shearing forces between the gearbox 45 and the frame-head means 15 away from the shank of the screw 105. The screw 105 merely needs to transmit tensile forces, not shearing forces.

If need be, as shown in FIG. 5, washers 106 and 107 respectively may also be arranged between the extension 101 and the, frame head 15 and respectively under the head of the screw 105.

During the assembly, first of all the gearing 19 is assembled; specifically, the assembly of the gearing 19 starts with the installation of the layshaft 55. After the ball bearing 56 has been inserted, the gear 53 is inserted from a side opening in the side-wall arrangement 48, and then the layshaft 55 interlocked with the pinion 54 is inserted through the bearing seating bore 59 until it fits with its corresponding shaft stub in the ball bearing 56. The ball bearing 56 is axially secured by appropriate retaining rings. After the layshaft 55 has been inserted, the rolling-contact bearing 57 is inserted and is likewise axially secured by appropriate retaining rings.

In the course of the further assembly of the gearing 19, the ball bearing 63 and then the distance ring 75 are slipped onto the output shaft 61. After the ball bearing 62 has been pressed into the bearing seat 65, the output gear 74 is pushed in laterally through another assembly opening in the side-wall arrangement 48 until the hub bore of the output gear 74 is in alignment with the deep-groove ball bearing 62. The output shaft 61 fitted with the ball bearing 63 is then inserted from the gearbox end wall 46 into the gearbox 45, the profile interlocking system 73 coming into engagement with a corresponding profile interlocking system in the output gear 74 in order to secure the output gear 74 to the output shaft 61 in a rotationally locked manner. Finally, the retaining ring 76 and the retaining ring 69 secure the output shaft 61 axially in the gearbox 45.

As soon as the gearing 19 has been ready-assembled to this extent, the drive motor 18 is flange-mounted on the gearbox end wall 46. Its pinion 52 then meshes with the gear 53.

The unit preassembled in this manner, consisting of gearing 19 and drive motor 18, may now be fastened to the frame 13. As FIG. 3 shows, the frame-head means 15 has been fastened to the head piece 24 of the frame 13. The preassembled unit consisting of gearing 19 and drive motor 18 is brought to bear with the gearbox end wall 46 against the frame head 15 from outside, specifically in such a way that the fitting holes 99 are in alignment with the respectively associated holes 42, which are likewise fitting holes. The flanged bushes 103, as shown in FIG. 5, are then inserted from the side of the end plate 78 into the frame head 15, and the screws 105 are inserted and tightened in the thread 102 of the gearbox 45.

The bearing arrangement 37 may then be assembled; specifically, the bearing support 95 is inserted into the opening 98 of the frame head 16 and fastened thereto by means of the fastening screws 97. The ball bearing 92, which if need be may also be a self-aligning roller bearing, is then inserted into the bearing support 95 and axially secured by means of retaining rings (not discernible in any more detail). After this preparatory work, the journal 91, as shown in FIG. 4, is inserted into the ball bearing 92 and likewise secured with the retaining ring 93. The bearing arrangement 37 thus completely assembled and the rope drum 17 can be slipped onto the flange plate 89. In the process, the flange plate 89 penetrates into the recess 87 until it bears with its annular shoulder 81 against the base of the recess 87. The screws 88 are screwed into the holes 82, in alignment with one another, in the flange plate 89 and the rope drum 17.

To complete the assembly, the rope drum 17 is slipped onto the end plate 78, again until the end plate 78 butts against the base of the associated recess 86. Once this has been done, the screws 88 are screwed into the flange plate 78, and the frame-head means 16 is tightly screwed to the leg 31. An arrangement is thus finally obtained as shown in FIG. 2.

On account of the special design of the frame 13, it is torsionally nonrigid to a sufficient extent between the bearing arrangement 37 and the mounting for the output shaft 61 to take up parallelism errors and wobbling runouts of the axis of the bearing journal 91 relative to the axis of the output shaft 61.

Assuming that the axes of the bearing journal 91 and the output shaft 61 are at an angle to one another, the frame 13, during the rotation of the rope drum 17, performs a tumbling movement in such a way that the plane defined by the two legs 40 and 41 correspondingly wobbles relative to the plane defined by the frame head 16. In the process, the wobble angle corresponds to the angular error between said axes. This wobbling movement is made possible because the two frame head 15 and 16 are platelike and are easily movable in a direction parallel to the axis of the rope drum 17. Furthermore, this wobbling movement becomes possible because only one strut 22 runs parallel to the axis of the rope drum 17 and this strut 22 is sufficiently flexible.

The other conceivable alignment error consists in the fact that the axis of the bearing journal 91, although parallel to the axis of the output shaft 61, is slightly offset laterally relative the latter. In the case of this alignment error, the plane defined by the two legs 40 and 41 performs a parallel displacement relative to the plane defined by the frame head 16, the longitudinal member 22 being stressed in torsion and bending.

As a rule, however, both alignment errors described above are present at the same time, so that the compensating movements described above in the frame 13 are superimposed on one another. In any case, however, the compliance, which is also helped by the two legs 40 and 41, is proportioned in such a way that, on the one hand, the forces which originate from the load hanging on the rope can be transmitted to the travel rail 2, but, on the other hand, the frame 13 is so flexible that the distortions, occurring due to the alignment errors, in the frame 13 do not impair the service life of the bearings loaded as a result, namely the ball bearing 92 in the bearing arrangement 37 and the ball bearings 62 and 63, with which the output shaft 61 is mounted.

In a practical embodiment having two-fall rope guidance, the following elasticity results: a load of 2500 kg, at a drum length of 953 mm, causes torsion of the frame head 15 relative to the frame head 16 by 0° 37' if the rope lead-off is effected at one of the ends of the rope drum 17. The torsion is measured as displacement of the intersection of the axis of the ball bearing 92 with the surface of the, frame head 15, specifically starting from the position of this intersection in the unloaded state relative to the position of the intersection in the loaded state of the lifting appliance. In this case, the reference axis for the angle measurement is approximately the center of the strut 22. The latter is at a distance of about 206 mm from the axis of the ball bearing 92, which corresponds to an offset of the intersection by about 2.3 mm.

Furthermore, in this exemplary embodiment, the admissible tolerance between the axes of rotation at the ends of the rope drum 17 is about 3 to 4 mm, i.e. the ball bearing 92, in the assembled and unloaded state, may have an axial offset of about 4 to 10 mm relative to the ball bearings 62 and 63 without this enormous tolerance significantly impairing the service life of the ball bearings 92, 62 and 63.

A further improvement can be achieved if, in addition, the ball bearing 92 is designed as a self-aligning bearing, since the wobbling runout of the bearing journal 91 in the self-aligning bearing is then compensated for and virtually no compensating movement of the frame 13 is necessary.

In a rope hoist, the rope drum is rotatably mounted in a roughly C-shaped frame. To mount the rope drum, an appropriate bearing arrangement is provided at one side, whereas at the other side the mounting of the rope drum is effected solely via the output shaft of the gearing. Distortions in the frame on account of unavoidable alignment errors are absorbed by the torsionally nonrigid frame.

What is claimed is:

1. A rope hoist comprising:

a frame including a frame base and first and second frame heads, said first and second frame heads being secured to said base in outwardly extending parallel relation to each other, a gearbox having an output shaft rotatably supported by bearings, a motor having a motor shaft operatively coupled to said gearbox for rotatably driving said output shaft, a rope drum supported between said first and second frame heads for relative rotational movement, said rope drum having one end coupled to said gearbox output shaft and another end supported within a bearing member mounted on said second frame head, said first and second frame heads each comprising a substantially flat plate portion extending in cantilever fashion from said frame base without transversely extending rigidifying structure, said flat cantilever extending plate portions providing a torsionally non-rigid elastic support for said drum that absorbs relative movement between said gearbox output shaft support bearings and said bearing member and movement caused by alignment errors between said output shaft and bearing member.

2. The rope hoist according to claim 1 wherein said motor shaft extends through a hole in said gearbox.

3. The rope hoist according to claim 2, wherein said motor shaft is parallel to the axis of the rope drum.

4. The rope hoist according to claim 1, wherein the motor is located outside the rope drum.

5. The rope hoist according to claim 1, wherein the frame base includes a first head piece spaced apart from a second head piece, and a longitudinal member extending therebetween.

6. The rope hoist according to claim 5, wherein the frame has a C-shaped configuration defined by the first frame head, the second frame head and the longitudinal member.

7. The rope hoist according to claim 5, wherein the longitudinal member is parallel to the rope drum.

8. The rope hoist according to claim 5, wherein the longitudinal member, the first head piece and second head piece are tubular.

9. The rope hoist according to claim 8, wherein the longitudinal member, the first head piece and second head piece have a square cross-section.

10. The rope hoist according to claim 1, wherein the first frame head includes a plurality of leg members configured to receive the output shaft and the second frame head is configured to receive the bearing member.

11. The rope hoist according to claim 1, wherein a screw is threaded through a flanged bush received in a plurality of apertures formed in the gearbox and the first frame head.

12. The rope hoist according to claim 1, wherein the bearing member is a bearing journal.

13. The rope hoist according to claim 12, wherein the bearing journal is self-aligning.

14. The rope hoist according to claim 11, wherein the first frame head is located between the rope drum and the gear box.

15. The rope hoist according to claim 1, wherein the frame is located in a crab carriage.

16. The rope hoist according to claim 11 in which said gearbox is mounted on said first frame head.

17. The rope hoist according to claim 16 in which said motor is mounted on said gearbox.

18. The rope hoist according to claim 11 in which said rope drum has an end plate at one end connected to said output shaft and an end plate at another end coupled to a journal rotatably supported within said second frame head.

19. The rope hoist according to claim 11 in which said gearbox output shaft is rotatably supported by bearings located within said gearbox, and one end of said rope drum is fixed to said output shaft without additional bearing support.

20. A rope hoist comprising:

a frame including a frame base and first and second frame heads, said first and second frame heads being secured to said base in outwardly extending parallel relation to each other, a rope drum supported between said first and second frame heads for relative rotational movement, a drum drive motor operatively coupled to said rope drum for rotatably driving said rope drum, said first and second frame heads each comprising a substantially flat plate portion extending in cantilever fashion from said frame base without transversely extending rigidifying structure, said flat cantilever extending plate portions providing a torsionally non-rigid elastic support for said drum that absorbs relative movement caused by alignment errors between said rope drum, its supports, and its operative coupling to said drive motor.

21. The rope hoist according to claim 20 in which said rope drum has an end plate at one end connected to said output shaft and an end plate at another end coupled to a journal rotatably supported within said second frame head.

22. The rope hoist according to claim 20 in which said first frame head has an outwardly opening slot within which one end of said rope drum is supported for relative rotational movement.

23. The rope hoist according to claim 20 in which said rope drum is mounted with said axis of rotation parallel to said frame base.

24. The rope hoist according to claim 20 including a gearbox coupled to said drive motor, said gearbox being mounted on said first frame head having an output shaft rotatably supported by bearings located within said gearbox, said gearbox output shaft being fixedly coupled to one end of said rope drum, and another end of said rope drum being supported by bearings carried in said second frame head.

25. A crab for movement along a travel rail comprising:

a crab carriage having wheels for supporting the carriage for rolling movement along a travel rail, said carriage comprising first and second cheeks for positioning on opposite sides of the travel rail a carriage drive motor supported on said first cheek for powering said carriage along the travel rail, said second carriage cheek including a frame having a frame base and first and second frame heads, said first and second frame heads being secured to said base in outwardly extending parallel relation to each other, a rope drum supported between said first and second frame heads for relative rotational movement, a drum drive motor operatively coupled to said rope drum for rotatably driving said rope drum, said first and second frame heads each comprising a substantially flat plate portion extending in cantilever fashion from said frame base without transversely extending rigidifying structure, and said flat cantilever extending plate portions providing a torsionally non-rigid elastic support for said drum that absorbs relative movement caused by alignment errors between said rope drum, its supports, and its operative coupling to said drive motor.

26. The crab according to claim 25 including a gear box mounted on said first frame head having an output shaft driven by said drive motor, and said rope drum being fixedly coupled at one end to said output shaft.

27. The crab according to claim 26 in which said drum drive motor is mounted on said gearbox.

28. The crab according to claim 25 in which said drum is supported between said first and second frame heads with its axis of rotation parallel to the travel rail upon which the crab is positioned.

29. The crab according to claim 25 in which said first frame head is formed with an outwardly opening slot within which one end of said rope drum is supported for relative rotational movement.

30. The crab according to claim 29 in which said slot defines a pair of flexible drum supporting legs.

31. The crab according to claim 25 in which said drum drive motor includes a gearbox having an output shaft coupled to said rope drum, said gearbox output shaft being supported by bearings, and an end of said rope drum opposite the end coupled to said output shaft being supported by a bearing member mounted on said second frame base.

* * * * *